US005812962A

United States Patent [19]

Kovac

[11] Patent Number: 5,812,962

[45] Date of Patent: Sep. 22, 1998

[54] METHOD AND APPARATUS FOR ORGANIZING STORING AND RETRIEVING INFORMATION TO ADMINISTER A SEWER SYSTEM

[75] Inventor: Paul V. Kovac, White Oak, Pa.

[73] Assignee: White Oak Borough Authority, White Oak, Pa.

[21] Appl. No.: 761,898

[22] Filed: Dec. 9, 1996

[51] Int. Cl.[6] ..... E03F 3/00

[52] U.S. Cl. ..... 701/208; 701/212; 364/420; 364/560

[58] Field of Search ..... 364/505, 420, 364/449.2, 512, 560, 570, 400; 395/928–930; 405/36, 32, 132; 404/2; 52/169.1, 169.2, 20; 434/150–153; 340/990, 995, 286.14; 283/34, 35; 33/1 G, 1 H, 20.4; 701/208, 212

[56] References Cited

U.S. PATENT DOCUMENTS 5,385,371 1/1995 Izawa ..... 283/35
5,543,788 8/1996 Mikuni ..... 340/995
5,636,122 6/1997 Shah et al. ..... 364/449.1

*Primary Examiner*—Emanuel Todd Voeltz
*Assistant Examiner*—Hal D. Wachsman
*Attorney, Agent, or Firm*—Webb Ziesenheim Bruening Logsdon Orkin & Hanson, P.C.

[57] ABSTRACT

A composite code assigned to each manhole of a sewer system in a geographical region is associated with an x-y location of the manhole on a digitized geographical map of the region containing a representation of the sewer system including manholes plotted thereon. The composite code is stored in a memory of a computer. Other information regarding each of the manholes is entered into corresponding records stored in the memory of the computer. The composite code is utilized as a link between the record for each manhole and the x-y location of each manhole on the digitized map. Utilizing a computer mouse, an x-y location associated with a location of a manhole on a display of the digitized map containing the sewer system is selected. In response to the selection, the record associated with the selected manhole is retrieved from the computer's memory utilizing the composite code. The retrieved record is displayed on the display.

19 Claims, 7 Drawing Sheets

Fig. 2.

A1 ALLEN WAY
A2 AMHURST ST.
A3 ANDREW ST.
A4 ANTHONY ST.
A5 ARTHUR ST.
A6 AULD ST.
A7 BENNETT ST.
A8 BERNARD ST.
A9 BONITA CT.
B1 BRIARHILL CT.
B2 BRIDGEVIEW AVE.
B3 BROADWAY
B4 "C" WAY
B5 CALIFORNIA AVE.
B6 CAPITOL ST.
B7 CARMELLA DR.
B8 CAROLINA DRIVE
B9 CATHERINE DR.
C1 CENTER ST.
C2 CENTER ST. EXT.
C3 CHERRY WAY
C4 CHESAPEAKE AVE.
C5 CIRCLE DRIVE
C6 CLARK STREET
C7 CLEARVIEW DR.
C8 CLINTON ST.
C9 CONGRESS ST.
D1 COOK ST.
D2 COOL SPRINGS RD.
D3 COULTER RD.
D4 CYPRESS STREET
D5 DAREN COURT
D6 DEARBORN DRIVE
D7 DELAWARE AVE.
D8 DIVISION ST.
D9 DOME ST.
E1 EASTVIEW DR.
E2 EDUCATIONAL DR.
E3 EISENHOWER DRIVE
P1 ELENIC COURT
E4 FALLEN WAY
E5 FAWCETT AVENUE
O7 FERN ALLEY
E6 FORGIE ST.
E7 FOSTER ROAD
E8 FOSTER STREET
E9 FRANKLIN ST
F1 GARDEN STREET
F2 GEORGE STREET
F3 GLASS STREET
F4 GUICE STREET
F5 HEMLOCK DR.
F6 HENDERSON DR.
F7 HERR DRIVE
F8 HIGH STREET
O3 HILL STREET
F9 HORIZON DRIVE
G1 JACKS RUN ROAD
G2 JAMES STREET
G3 JOHNS ALLEY
G4 JOSEPHINE STREET
G5 KANSAS AVENUE
G6 KELLY STREET
O9 KENSCOTT ST.
G7 LAUREL LANE
G8 LEWIS STREET
G9 LINCOLN WAY
H1 LONG RUN ROAD
H2 LONGVUE DR
H3 LOWER HECKMAN ROAD
P2 LYNCH LANE (PARK)
H4 MAIN STREET
H5 MAPLE STREET
H6 MARIETTA DRIVE
H7 MCCLINTOCK ROAD
H8 MCCLURE ST.
H9 MCCULLY STREET
I1 MCKEE ROAD
I2 MESSENGER LANE
I3 MIDWAY STREET
I4 MOWHAWK DRIVE
I5 MONONGAHELA BLVD.
I6 MUSE LANE
I7 MEYERS LANE
I8 NELSON STREET
I9 NEW JERSEY ST.
J1 O'NEIL BLVD
J2 OAKVIEW DRIVE
J3 OHIO AVENUE
J4 OLD JACKS RUN ROAD
J5 OLIVER DRIVE
J6 OSBORNE DRIVE
J7 OSCEOLA DRIVE
J8 PALM STREET
J9 PARK MANOR DRIVE
K1 PARK WAY
K2 PEACH WAY
K3 PENN CREST CIRCLE
K4 PENN CREST DRIVE
K5 PENNSYLVANIA AVENUE
K6 PLEASANT DRIVE
K7 POINSETTIA DRIVE
K8 POND WAY
K9 PRESCOTT STREET
L1 PUBLIC ROAD
L2 QUAY STREET
O8 UNIVERSITY DRIVE
L3 RANKIN ROAD
L4 RAYMOND ALLEY
L5 REIMAN STREET
L6 RIPPLE ROAD
L7 RIVERVIEW DRIVE
L8 ROYAL OAK DRIVE
L9 SALLEY STREET
O4 SEMINOLE STREET
M1 SENATE STREET
M2 SHARP STREET
M3 SHERBINE WAY
M4 SHORT STREET
M5 SKELLY STREET
M6 SPRUCE STREET
M7 STAISEY STREET
M8 STATE STREET
M9 STEWERTSVILLE ROAD
N1 SUMMIT STREET
N2 SUNSET STREET
O5 SUSAN STREET
N3 TANGLEVIEW DRIVE
N4 THOMAS DRIVE
N5 UPPER HECKMAN ROAD
N6 VERMONT STREET
N7 VICTORIA DRIVE
N8 WALTER STREET
N9 WHITE OAK DRIVE
P3 WHITETAIL LANE
O1 WILLARD DRIVE
O2 YORK STREET
O3 HILL STREET
O4 SEMINOLE STREET
O5 SUSAN STREET
O7 FERN ALLEY
O8 UNIVERSITY ALLEY
O9 KENSCOTT DRIVE
P1 ELENIC COURT
P2 LYNCH LANE (PARK)
P3 WHITETAIL LANE

Fig.3.

| Composite Codes | Location | Distance To Downstream Manhole |
|---|---|---|
| A1-36-A | ALLEN WAY-CLEAN OUT AT END | 113 |
| A1-36-C | ALLEN WAY-BELOW C WAY | ? |
| A2-10-A | 1031 AMHERST STREET | 404.4 |
| A2-10-B | 1048 AMHERST STREET | 226.75 |
| A2-11-A | 1108 AMHERST STREET | 249.5 |
| A2-11-B | 1116 AMHERST STREET | 209.3 |
| A2-11-C | 1118 AMHERST STREET | 45 |
| A2-11-D | 1124 AMHERST STREET | 153 |
| A2-11-E | 1148 AMHERST STREET | 199 |
| A3-13-A | ANDREW (AT DEAD END OF STREET) | 63 |
| A3-13-AR | ANDREW AT THE CREEK | 150 |
| A3-13-B | 2671 ANDREW ST.(BELOW) | 198.75 |
| A4-01-A | ANTHONY DRIVE (DEAD END MH.) | 243.5 |
| A4-01-B | ANTHONY DRIVE-BEHIND 3510 FOSTER ROAD | 348 |
| A4-01-C | ANTHONY DRIVE NEAR LOWER HECKMAN ROAD | 234 |
| A5-25-A | ARTHUR STREET AT ALLEY | 150 |
| A6-29-A | AULD STREET-(BETWEEN OHIO AVENUE & KANSAS AVENUE) | 166 |
| A6-G3 | AULD STREET AT JOHNS ALLEY | 305 |
| A8-01-AR | BERNARD DRIVE R.O.W.-BEHIND 101 BERNARD | 175.75 |
| A8-01-BR | BERNARD DRIVE R.O.W.-BEHIND 113-117 | 305.583 |
| A8-01-CR | BERNARD DRIVE R.O.W.-TOP OF HILL | 61.5 |
| A8-01-DR | BERNARD DRIVE R.O.W.-FOOT OF HILL | 58.667 |
| A9-01-A | 110 BONITA COURT | 223 |
| B1-01-A | BRIARHILL COURT-1ST MH. OFF PENN CREST CIRCLE | 90 |
| B2-09-A | BRIDGEVIEW AVENUE AT BRIDGE (CLOSEST TO ROAD) | 11 |
| B2-09-B | BRIDGEVIEW AVENUE AT BRIDGE-MIDDLE MH. | 7.25 |
| B2-09-C | BRIDGEVIEW AVENUE AT BRIDGE (CLOSEST TO BRIDGE) | 104 |
| B2-M1 | BRIDGEVIEW AVENUE & SENATE STREET | 141 |

MH Code

Block Code

Street Code

METHOD AND APPARATUS FOR ORGANIZING STORING AND RETRIEVING INFORMATION TO ADMINISTER A SEWER SYSTEM

BACKGROUND OF THE INVENTION

1. Field of the Invention

The present invention relates to methods and apparatus for the administration of a utility and more specifically, to methods and apparatus for the administration of a sewer system.

2. Description of the Prior Art

Sewer systems are utilized to transport rain water or waste from one location to another. Sewer lines utilized to remove waste from residences, businesses and the like are typically called sanitary sewers. Sewer lines utilized to remove rain water, runoff water and the like are typically called storm sewers.

Blockage of these sewer lines is cause for concern because of the potential for water or raw sewage to be transported into buildings, such residences or commercial establishments, with corresponding inconvenience, health concerns and destruction of property. Moreover, because sanitary sewers and storm sewers both transport liquids, it is not uncommon for residences or businesses to mistakenly connect to the incorrect line. That is, the waste line from a residence or business is connected to the storm sewer or the storm line from a residence or business is connected to the sanitary sewer. This cross connection would, in the first instance, result in raw untreated sewage being introduced into a storm sewer and transported to a runoff, a holding basin, a stream, a lake or the like. Obviously, this is cause for concern because of health hazards presented to individuals and wildlife by direct or indirect exposure to such raw sewage and because of the potential deleterious effect on the environment. In the second instance, the introduction of storm water into the sanitary sewer results in unnecessary loading of the sanitary sewer system with corresponding increased operating costs. Moreover, improper loading of the sanitary sewer system also has another component, namely, increased capital costs associated with having to provide a sanitary sewer treatment system with waste handling capacity in excess of the actual waste treatment requirements.

Sewer lines are typically located underground and are therefore exposed to, among other things, ground water, ground based minerals and tree roots, all of which, over time, cause partial or complete deterioration or blockage of these lines. When a line deteriorates sufficiently, the line must be repaired or replaced to ensure the integrity of the system. Because sewer lines are underground, however, they cannot be easily inspected to determine when replacement needs to occur. Accordingly, it is common that the need to replace a sewer line becomes apparent only after the sewer line breaks and fluid in the sewer line is noticeably discharged into the environment, or an unusual increase or decrease in flow is observed or water or sewage or both back-up into a building that is serviced by the sewer line.

It is desirable to inspect sewer lines periodically to determine the condition of the sewer lines. Such inspection is accomplished by either first hand visual inspection or by remotely maneuvering a camera through a sewer line and visually inspecting the interior of the line on a remote viewing device. A benefit of camera inspection is the ability to record the inspection for later viewing and comparison with another recorded inspection of the same sewer line taken at a different time. In this manner, the condition of the sewer line can be accessed and appropriate measures taken to avoid line blockage and to plan for the replacement of a portion of the sewer line in advance of failure. Another benefit of camera inspection is the ability to locate lost or buried manholes.

A sewer system typically includes manholes conveniently positioned throughout the system to provide access to the sewer system for the purpose of repair, maintenance, inspection and the like. Because most sewer systems are quite extensive, it is not uncommon for a sewer system to have hundreds, or even thousands, of manholes. Moreover, manholes also serve as points of reference for determining the course of the sewer line and for identifying a section of the sewer line that extends between two or more manholes.

It is desirable to know the precise location of manholes and to be able to distinguish between manholes in a sewer system for the purpose of administering the repair, maintenance, inspection and the like of the sewer lines. Unfortunately, however, heretofore the identification of manholes and has either not occurred or has been arbitrary with little or no attention being given to structured inventory of manholes. Furthermore, precisely locating manholes and tracking the location thereof from one or more fixed points of reference has typically not occurred.

It is an object of the present invention to provide a method of organizing, storing and retrieving information for the administration of a sewer system. It is another object of the present invention to provide a method of administering a sewer system contained in a geographical region. It is yet another object of the present invention to provide an apparatus for administering a sewer system contained in a geographical region. It is still yet another object of the present invention to provide a method of organizing and tracking data for the administration of a utility.

SUMMARY OF THE INVENTION

Accordingly, we have invented a method and apparatus for organizing and administrating a sewer system.

In one embodiment of the method, a street code is assigned to each of a plurality of streets in a geographical region that includes a sewer system having a plurality of manholes. A block code is assigned to each block of each of a plurality of streets in the geographical region. A manhole code is assigned to each manhole in each block in each of the plurality of streets in the geographical region. The manhole codes are combined with corresponding block codes and street codes to obtain a composite code for each manhole in the geographical region. The location of each manhole in the geographical region is determined and plotted on a map of the geographical region. The map with the location of the manholes plotted thereon is digitized and stored into a memory of a computer. In the computer, each composite code is associated with the x-y location of its corresponding manhole on the digitized map. Information for at least one manhole in the sewer system is obtained and stored in a record in the computer. The record information obtained for each manhole is associated with a composite code for the corresponding manhole. A viewable image of the map with manholes displayed thereon is produced on a display means. One of the manholes on the viewable image of the map is selected. In response to the selection, the record containing the obtained information for the selected manhole is retrieved from the computer utilizing the composite code associated with the selected manhole. The retrieved record is displayed on the display means.

In the method, the composite code at the intersection of two or more streets is comprised of the unique street codes for each street. The composite code for manholes not adjacent a street includes an off-street designator.

In the method, a picture of a sewer system is obtained and associated with a selected manhole in the sewer system. The obtained picture is introduced into a record in the computer and associated in the computer with a composite code for the selected manhole. In response to the selection of the manhole on the viewable image, the record containing the picture is retrieved therefrom utilizing in the composite code associated with the selected manhole. The retrieved picture is displayed on the display means.

In accordance with another embodiment, a street code is assigned to each street in a geographical region, a block code is assigned to each block of each street and a manhole code is assigned to each manhole in each block. The street codes, the block codes and the manhole codes are merged to obtain a plurality of composite codes uniquely corresponding to the manholes in the geographical region. The location of each manhole in the geographical region is determined. The determined location of each manhole is introduced into a record for each manhole in the computer. Information about each manhole is obtained and introduced into a record for each manhole in the computer. The composite code for each manhole is associated with the location of each manhole and the corresponding record containing information obtained about the manhole. A viewable image of the geographical region with manholes displayed thereon is produced on a display device. An x-y location of one of the manholes corresponding to the determined location of the selected manhole is selected on the viewable image. In response to the selection, the record containing the information obtained about the selected manhole is retrieved from the computer utilizing the composite code associated with the selected manhole.

In another embodiment of the method, an x-y location for each of a plurality of elements associated with a utility is identified on a map of a region containing the utility. The map and the identified location of the plurality of elements is digitized and entered into a computer. A unique code is assigned to each of the plurality of elements. The unique code assigned to each of the plurality of elements is entered into the computer. The identified location of the plurality of elements is associated with the unique codes assigned thereto. Information regarding each of the plurality of elements is entered into corresponding records in the computer, which records are associated with the unique codes assigned to each of the plurality of elements. The identified location of one of the plurality of elements is selected on a computer generated display of the digitized map. In response to this selection, the record of entered information corresponding to the selected element is retrieved from the computer.

In an apparatus in accordance with the present invention a computer memory means stores geographical map data for a geographical region that includes a sewer system including a plurality of manholes. The map data includes an x-y location of each of the plurality of manholes in the geographical region. A computer memory means stores a unique composite code for each of the plurality of manholes in the geographical region. An association means associates the map data location for each manhole with its corresponding composite codes. A computer memory means stores records containing information regarding each of the plurality of manholes. An association means associates the records containing information regarding each of the plurality of manholes with their corresponding composite code. A viewing means displays a viewable image of the map data with the manholes included therein. A selection means selects one of the plurality of manholes displayed on the viewable image. A retrieving means retrieves the record containing information regarding the selected manhole utilizing the composite code associated with the selected manhole.

BRIEF DESCRIPTION OF THE DRAWINGS

FIG. 2 is a listing of streets in the geographical including assigned street codes;

FIG. 3 is a partial listing of composite codes for manholes in the geographical region including associated location information and distance to downstream manhole;

DETAILED DESCRIPTION OF THE PREFERRED EMBODIMENTS

Figure 1:
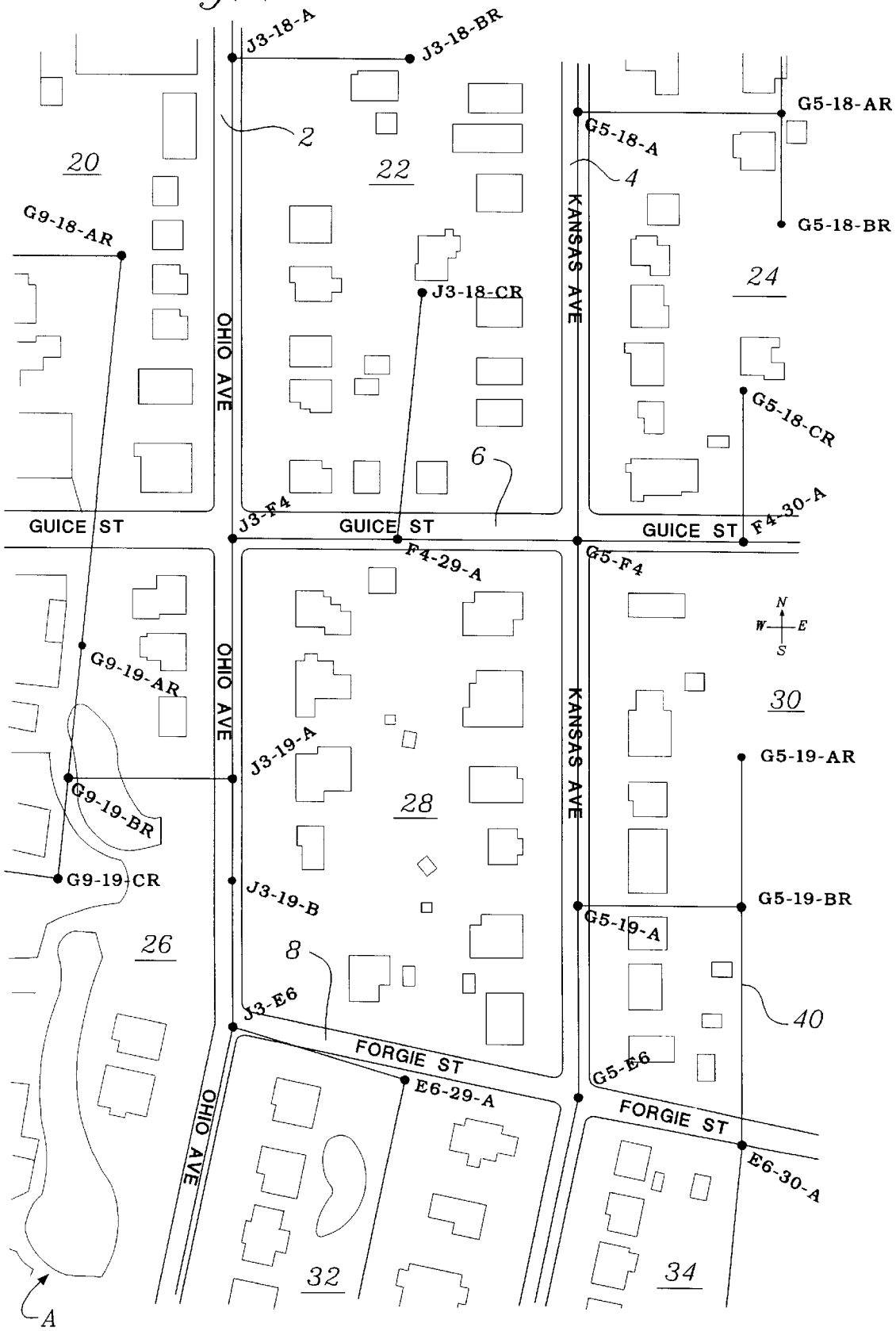
FIG. 1 is a map of a portion of a geographical region including streets and a sewer system that includes manholes.

With reference to FIG. 1, a geographical map A includes a plurality of streets, e.g., Ohio Ave. 2, Kansas Ave. 4, Guice St. 6 and Forgie St. 8. The intersection of streets in a geographical area defines a plurality of blocks, e.g., 20, 22, 24, 26, 28, 30, 32 and 34. Each of the blocks typically has one or more buildings thereon which has an assigned street address that is often related to a block number in which the building is located. Thus, by way of example and not of limitation, a block with buildings having an address in the nineteen hundreds would be the nineteenth block in the series of blocks. Alternatively, the block with addresses in the nineteen hundreds would be the ninth block in the series of blocks—the first block in the series of blocks beginning in the one thousands.

An underground sewer system 40, such as a storm sewer, has a plurality of sewer lines located under or adjacent one or more of the streets and connected to service the buildings in each block. The sewer system 40 has additional lines that extend from the streets and are connected to service buildings facing other streets or areas between streets. In FIG. 1, the sewer connections between buildings and the sewer system 40 have been omitted to simplify the drawing. It is to be understood, however, that the buildings are connected to the sewer system 40.

As shown in FIG. 1, the sewer system 40 includes a plurality of manholes, shown as plurality of points or dots, positioned at desired locations throughout the sewer system. The manholes are typically vertical pipes that extend between the underground sewer lines and a surface of the ground above the sewer lines. The manholes provide access to the sewer lines for the purpose of, without limitation, repair, maintenance and inspection of the sewer lines.

With reference to FIG. 2 and with continuing reference to FIG. 1, each street in a geographical area or region is listed in alphabetical order and assigned a unique street code. In the preferred embodiment, the first street name, e.g., Allen Way, is assigned a first alpha/numeric street code A1. The number of the first street code is increased by one to obtain a second street code, i.e., A2, which is assigned to the next street name in the alphabetical listing, e.g., Amhurst St. The number of the second street code is increased by one to obtain a third street code, i.e., A3, which is assigned to the next street name in the alphabetical listing, e.g., Andrew St., and so forth until street code A9 is assigned to the ninth street name in the alphabetical listing, e.g., Bonita Ct. The character of the ninth street code is increased by one character to B and the number of the ninth street code is reset to 1 to obtain the tenth street code B1 which is assigned to the tenth street name, e.g., Briarhill Ct. The increasing of the number in the street code is repeated for subsequent street names in the alphabetical listing until the street code B9 is assigned, e.g., to Catherine Dr. The character of street code B9 is increased by one character to C and the number of the street code is reset to 1 to obtain the next street code C1. The above assigning of street codes to street names is repeated in the foregoing manner until all of the streets are assigned a street code. It is to be appreciated that while the foregoing street codes have been described as having two symbols, one a character and the other a number, the street code could alternatively be comprised exclusively of characters or numbers. Moreover, the street code could also be expanded as required to include more than two symbols.

If it becomes desirable to assign a street code to a later included street, such as when a new street is developed, the later included street is appended to the end of the alphabetical list, regardless of the street name, and the next street code in the sequence is assigned thereto. Thus, by way of example, Hill Street is assigned the street code O3; Seminole Street is assigned street code O4 and so forth.

With reference to FIG. 3 and continuing reference to all previous Figs., block codes for blocks on a street are appended to the street code for the street so that for a plurality of blocks on a street a like plurality street code/block code combinations exist. In the preferred embodiment, the block code is related to street addresses for a corresponding block. In this manner, each block has a unique street code/block code combination. Thus, for example, the eighteen hundred block of Ohio Ave. 2 in FIG. 1 is assigned the street code/block code combination J3-18 and the nineteen hundred block of Ohio Ave. 2 is assigned the street code/block code combination J3-19.

Each manhole in a block, and not at an intersection of two or more streets, is assigned a sequential manhole character which is appended to the street code/block code combination to obtain a composite code utilized to uniquely identify each manhole. In a preferred embodiment, the sequence of manhole characters is started at one end of the block and increases progressively towards an opposite end of the block. Thus, in FIG. 1, the manhole at the north most end of Ohio Ave. 2 is assigned a first manhole character "A". Thus, the north most manhole in the nineteen hundred block of Ohio Ave. 2 has a composite code of J3-19-A and the next, or second, manhole south is assigned the second character B so that it has a composite code of J3-19-B. In the preferred embodiment, manhole characters A and B correspond to the numbers 1 and 2. It is to be appreciated however, that the manhole characters could be replaced with numbers or other suitable symbols.

Manholes at the intersection of two or more streets are assigned a composite code corresponding to the street codes of the intersecting streets. Thus, in FIG. 1, the manhole at the intersection of Ohio Ave. 2 and Guice St. 6 is assigned composite code J3-F4 which corresponds to the street codes assigned to Ohio Ave. 2 and Guice St. 6, respectively. Alternatively, the manhole at the intersection of Ohio Ave. 2 and Guice St. 6 could be assigned composite code F4-J3. It is obviously desirable, however, to avoid duplication of composite codes by assigning only one composite code to each manhole. Moreover, it is further desirable to consistently order the composite code for manholes at the intersection of two or more streets. For example, streets that extend generally North to South appear first in the composite code and streets that extend East to West appear second in the composite code.

Manholes within a specific block, e.g., block 30, and not adjacent a street are assigned an off street designator, such as the letter R, appended to the composite code. Thus, in FIG. 1, the East side of the nineteen hundred block of Kansas Ave. 4, i.e., block 30, has two manholes on the side of the buildings opposite Kansas Ave. 4 The North most manhole is assigned composite code G5-19-AR and the South most manhole is assigned composite code G5-19-BR.

The geographical location of each manhole is obtained by measuring its location relative to a stationary object, such as a building, preferably near the manhole. Once obtained, the geographical location of each manhole is plotted on a map of the region containing the sewer system. For each manhole, the distance to an upstream manhole and its corresponding composite code is also obtained. Similarly, the distance to a downstream manhole and its corresponding composite code is also obtained. Once obtained, the information regarding the geographical location of a manhole and its corresponding upstream and downstream manholes is utilized to generate a plot of the sewer system network on a geographical map of the region containing the sewer system.

The geographical map with sewer system network plotted thereon is digitized and introduced into a computer, and more specifically, a memory of the computer, for retention and manipulation. The composite codes for each manhole are also introduced into the computer's memory. Once introduced, the composite codes are associated with the location of their corresponding manholes on the computerized map introduced into the computer. This association is accomplished in the computer by assigning a desired composite code to the x-y location of the manhole on the computerized map and to select locations adjacent the assigned x-y location, in a manner known in the art. Moreover, other information regarding one or more manholes is obtained and introduced into the computer in the form of one or more records. This other information includes, without limitation, diameter of the manhole; date of last camera inspection of the manhole; date of last cleaning of the manhole; the depth of the manhole; distance to upstream manhole; distance to downstream manhole; composite code of upstream manhole; composite code of downstream manhole; picture data of said manhole; and picture data of sewer lines connected to said manhole. The other information obtained for each manhole is associated by record with the composite code for the corresponding manhole by assigning the composite code to the record containing the other information. Thus, the composite code acts to link the location of a manhole on the map introduced into the computer with records containing other information about the manhole separately introduced into the computer.

In operation, when a viewable image of the map is produced on a visual display means, such as a CRT, and when one of the manholes on the display is selected, such as by using a computer mouse to move a computer icon to the desired manhole and then actuating a switch on the mouse, i.e., point and click, the record containing information regarding the manhole is retrieved from the computer and displayed on the display means. In this manner, information regarding a manhole is quickly and easily retrievable by identifying its location on the computerized map in relation to the identifiable features in the geographical region serviced by the sewer system adjacent the manhole. Moreover, the ability to input information regarding a manhole, to observe the relation of a selected manhole relative to neighboring manholes and the ability to quickly and easily retrieve information regarding the neighboring manholes is also provided. This enables more accurate assessment of the status of the sewer system.

To aid in establishing a link between the location of a manhole and records containing the other information for the manhole, the composite code for the manhole is plotted on the map adjacent its corresponding manhole before the map is digitized and introduced into the computer. Thus, when the map with new sewer system, including manholes therein, is digitized and introduced into the computer, the composite codes for each manhole will be introduced into the computer in a form to be visually displayed on the display means adjacent its corresponding manhole, as shown in FIG. 1. Alternatively, composite codes can be introduced adjacent their corresponding manholes after the map is introduced into the computer. This is accomplished by electronically overlaying, in an overlay mode, the composite code on a viewable image of the computerized map displayed on a display means.

The composite code on the computerized map provides a visual marker on the computerized map that is indistinguishable by the computer from map information or the plot of the sewer system on the map. Accordingly, there still remains a need to associate the actual location of the manhole on the map with the composite code for the manhole. This is accomplished in the computer by assigning a desired composite code to the x-y location of the manhole on the computerized map and to select locations adjacent the assigned x-y location, in a manner known in the art.

The map can also contain topographical information, such as, elevational lines, that aid in accessing the direction of fluid flow in the lines of the sewer system. Thus, by bringing together a variety of data and information regarding a sewer system and by providing a structured way to organize, store and retrieve such information and data, the present invention enables the effective administration of the sewer system.

Information regarding other features on the digitized map can also be entered into the database so that when the computer icon is moved to one of these other features, such as a building, a record containing information regarding the other feature can be retrieved from the computer and displayed on the display means. For example, information regarding sewer testing of individual buildings can be obtained and stored in the computer for subsequent retrieval. This information can include test results regarding whether the building's storm sewer drains are connected to the sanitary sewer or the storm sewers.

In the foregoing description, the geographical map with sewer system, including manholes, was introduced into the computer. Alternatively, the sewer system, including manholes, could be introduced into the computerized map by drawing in an overlay mode, the sewer lines and manholes into the computerized map displayed on the display means. In this alternative, the location of each manhole is determined by reference to stationary geographic features. This location information is correlated to the corresponding stationary features on the computerized map and a symbol representing the manhole, e.g., a point or a dot, is introduced at the location on the computerized map corresponding to the geographical location of the manhole.

Pictures obtained during camera inspection of a manhole and corresponding sewer lines can also be merged with the manhole data information so that a viewable picture is available in conjunction with the records containing information about a manhole stored in the computer. Specifically, a camera introduced into the sewer system via a manhole is maneuvered through the lines of the sewer system to obtain visual images of the sewer system. The camera is connected to a suitable display means which visually displays the images obtained by the camera. A recording means, such as a VCR, is connected to the camera for recording on a recording medium, such as magnetic permeable tape, the images obtained by the camera. Once recorded, the images on the recording medium are viewable on a suitable video playback means which, in a preferred embodiment, is connected to a computer. In response to operator selection at the computer, a desired frame of the recorded visual images is transferred from the recording medium to a record in the computer via the playback means for retention and manipulation in the computer. The record of the transferred image is associated with a composite code for a manhole which is, preferably, nearby where the image was obtained.

Figure 4:
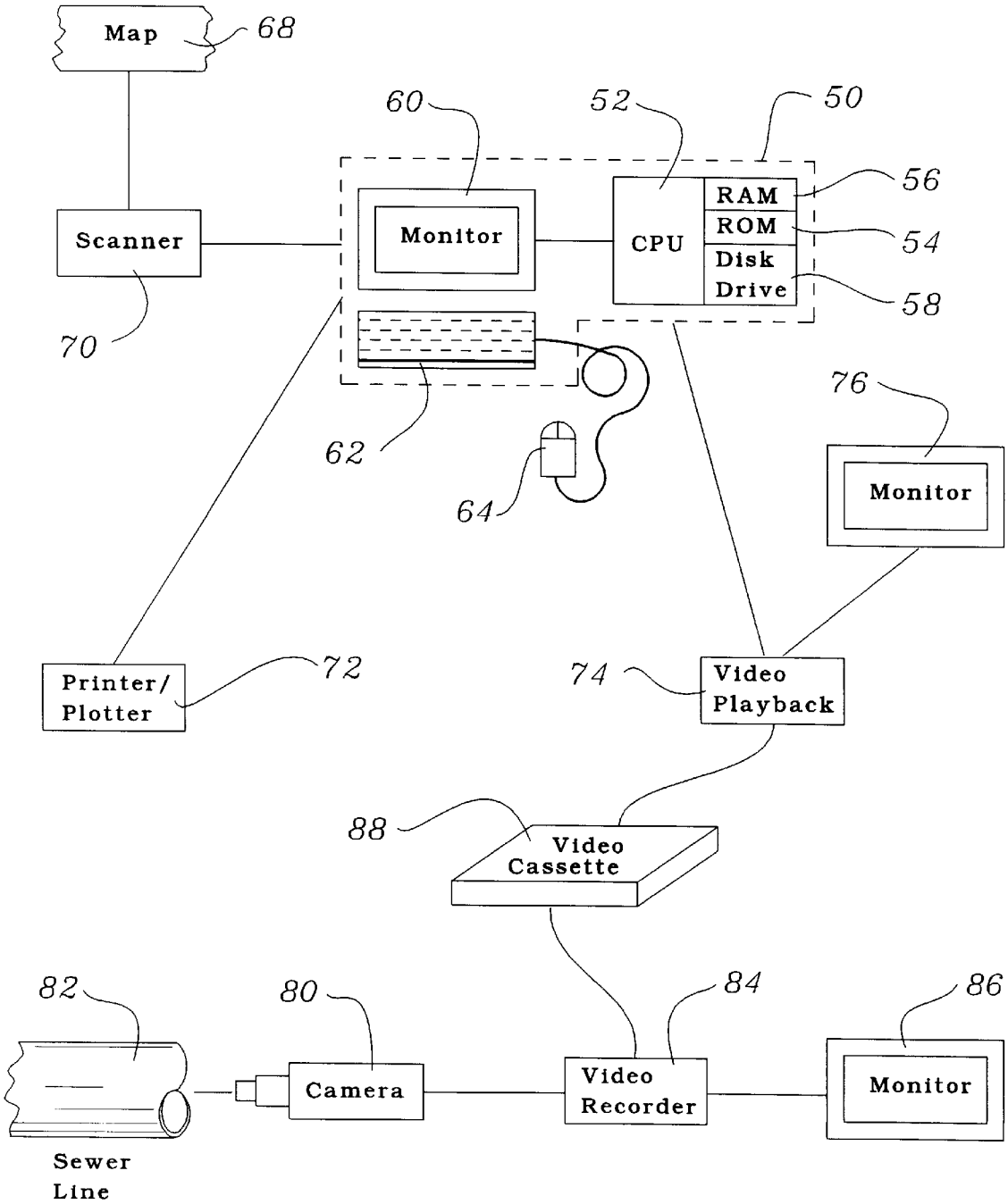
FIG. 4 is a block diagram of a computer system for administering a sewer system in accordance with the present invention.

With reference to FIG. 4, an exemplary apparatus for administering a sewer system includes a computer 50 that has a central processing unit (CPU) 52, permanent storage memory or ROM 54, temporary storage memory or RAM 56 and one or more disk drives 58, such as a floppy disk drive, a hard disk drive and/or a CD ROM or optical drive. The CPU 52 is connected to a visual display monitor 60, a keyboard 62 and a mouse 64 which cooperatively provide an interface between the CPU 52 and an operator. Map data related to the geographic region containing a desired sewer system is input into the computer 50 via disk drive 58. Alternatively, a map 68 of the geographic region is scanned through a scanner 70 which converts the map 68 into a stream of data useable by the computer 50.

A printer/plotter 72 is connected to receive an output from the computer 50. In response to control and data signals from the computer 50, the printer/plotter 72 produces a paper or film plot of a map contained in the computer 50.

A video playback means 74, such as a VCR, provides video data to the computer 50 in response to the computer 50 requesting the video playback means 74 to provide such data. A monitor 76 is connected to the video playback means 74 for viewing images produced by the playback means 74.

In operation, a geographic map with sewer system, including manholes, thereon is digitized and introduced into the RAM 56 of computer 50 utilizing disk drive 58 or scanner 70. With the map displayed on monitor 60, manipulation of one or both of the keyboard 62 and mouse 64 allows for the selection of a manhole on the displayed map. Once selected, the composite code for the selected manhole is caused to be associated with the x-y location of the selected manhole on the displayed map.

The keyboard 62 and mouse 64 are also utilized to input to the CPU 52 and RAM 56 other information about a selected manhole into a record. This other information is caused to be associated with the corresponding manhole by associating the record containing the other information with the composite code for the selected manhole. In this manner, the composite code provides a link between the location of the manhole on the digitized map and the record containing the other information separately stored.

A camera 80 is utilized to inspect a sewer line 82 and provides video data to a video recorder 84 and a display device or monitor 86. The video recorder 84 records on a video cassette 88 images of the sewer line 82 inspection by camera 80.

The recorded images recorded on the video cassette 88 are reviewable utilizing the video playback means 74 and monitor 76. If a desired image of sewer line 82 is observed during playback, a frame of the image can be frozen on the monitor 76. Activation of a key of keyboard 62 or mouse 64 causes computer 50 to copy the frozen frame of the image into RAM 56. Once in RAM 56, the frame of the image can be merged, in a manner known in the art, with a record containing other information. Alternatively, the frame of the image can be associated with a desired manhole by associating the composite code for the manhole with the frame of the image, or a record thereof, in a manner known in the art.

Figure 5A:
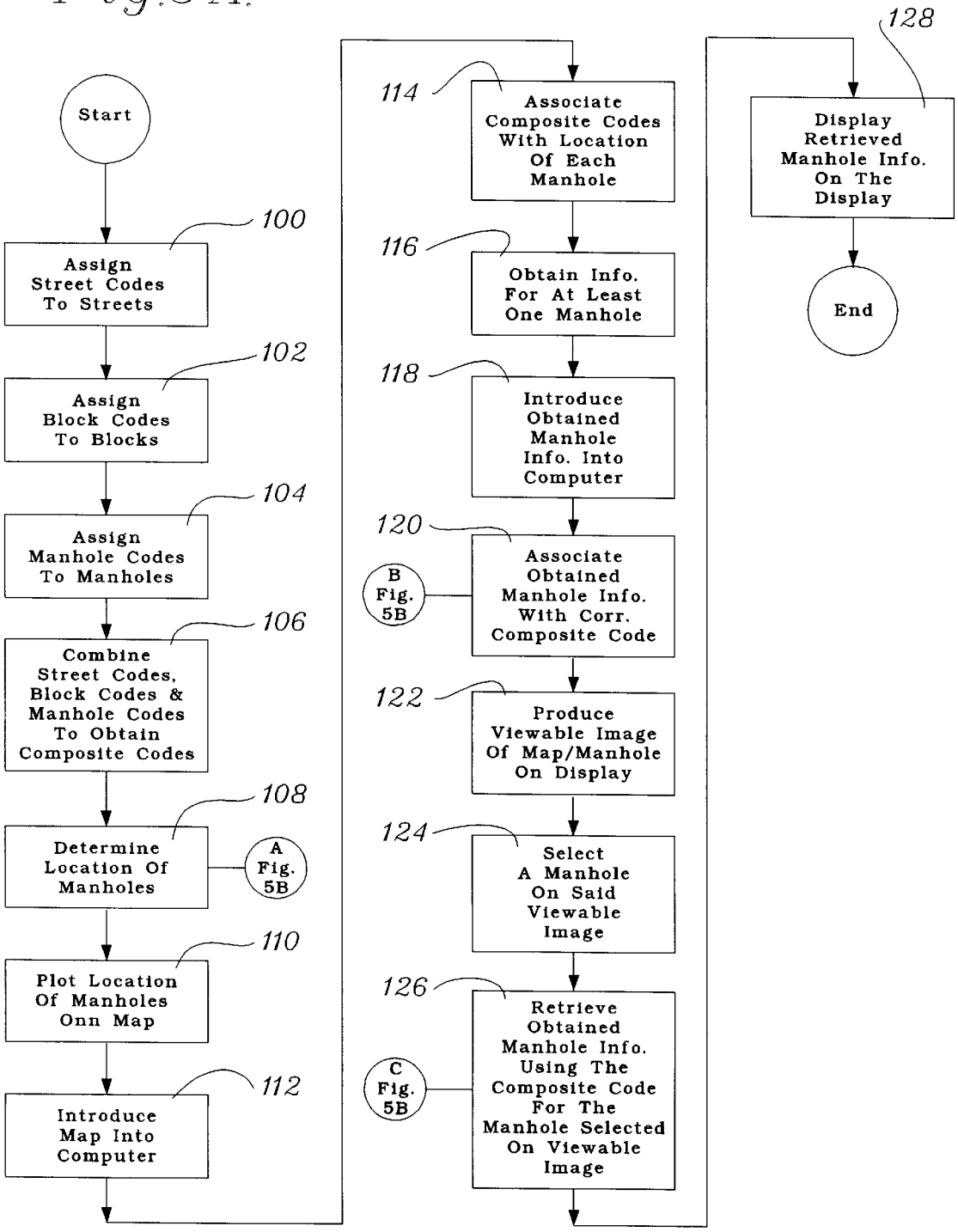
FIGS. 5A–5C are flow charts of the steps for administering a sewer system in accordance with the present invention.

With reference to FIG. 5A, an exemplary flow diagram illustrating the steps for entering and retrieving information regarding manholes includes step 100 wherein street codes are assigned to streets in a geographical region of interest, step 102 wherein block codes are assigned to blocks that comprise the streets and step 104 wherein manhole codes are assigned to manholes in the blocks. Once assigned, the street codes, block codes and manhole codes are combined or merged at step 106, to obtain a composite code for each manhole in the sewer system. At step 108, the location of each manhole in the sewer system is determined and, at step 110, plotted on a geographical map of the region. At step 112, the map with manholes plotted thereon is digitized and introduced to a computer. At step 114, the composite code for each manhole is associated with the x-y location of each manhole on the geographical map entered into the computer. At step 116, the information for at least one manhole is obtained and, at step 118, this information is introduced into the computer to form a record of such information. At step 120, the record of the manhole information is associated with the corresponding composite code.

At step 122, a viewable image of the map with manholes thereon is produced on a display and, at step 124, an operator selects one of the manholes on the viewable image. In response to the selection, at step 126, the record containing the manhole information is retrieved from storage utilizing the assigned composite code. At step 128, the retrieved manhole information is displayed on the display.

Figure 5B:
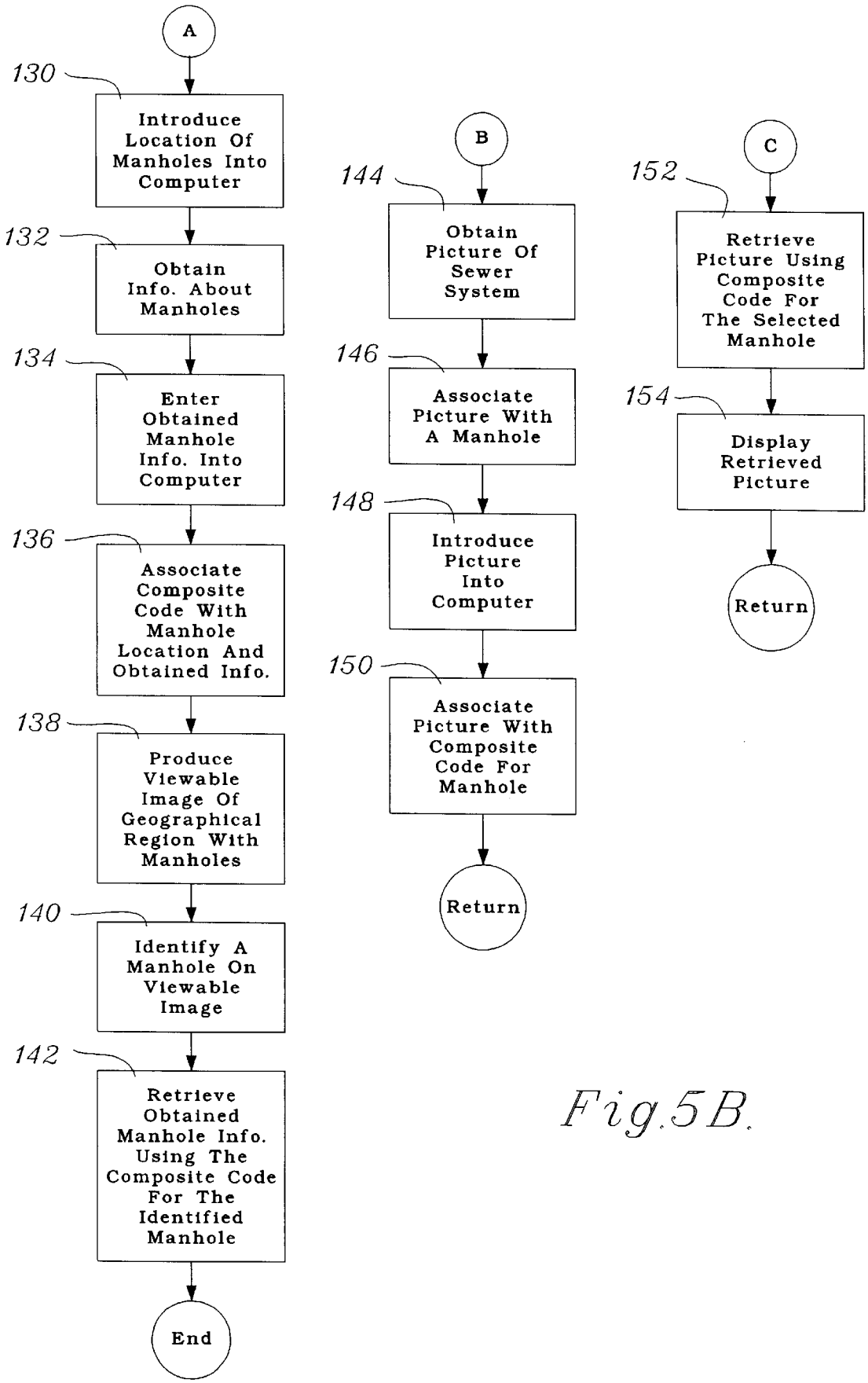

With reference to FIG. 5B and continuing reference to FIG. 5A, alternatively, once determined, the location of the manholes is entered into the computer at step 130. At step 132, information about the manholes is obtained and, at step 134, the obtained information is entered into the computer in the form of a record of such information for the manhole. At step 136, the composite code for each manhole is associated with the manhole location and the record of the manhole information entered into the computer. At step 138, a viewable image of the geographical region containing the sewer system is produced wherein the manholes appear at their proper location on the produced image. At step 140, a desired manhole is identified and selected on the viewable image. At step 142, the record of the manhole information for the identified manhole is retrieved from the computer utilizing the composite code.

In another embodiment, at step 144, a picture of the sewer system is obtained and is associated, at step 146, with a manhole in the sewer system. At step 150, the picture, or a record containing such picture, is introduced into the computer and associated with the composite code for the manhole assigned thereto. In response to the selection of a manhole on the viewable image, steps 122 and 124, the picture, or the record containing such picture, is retrieved, at step 152, from the computer using the composite code for the selected manhole. At step 154, the retrieved picture is displayed on the display.

Figure 5C:
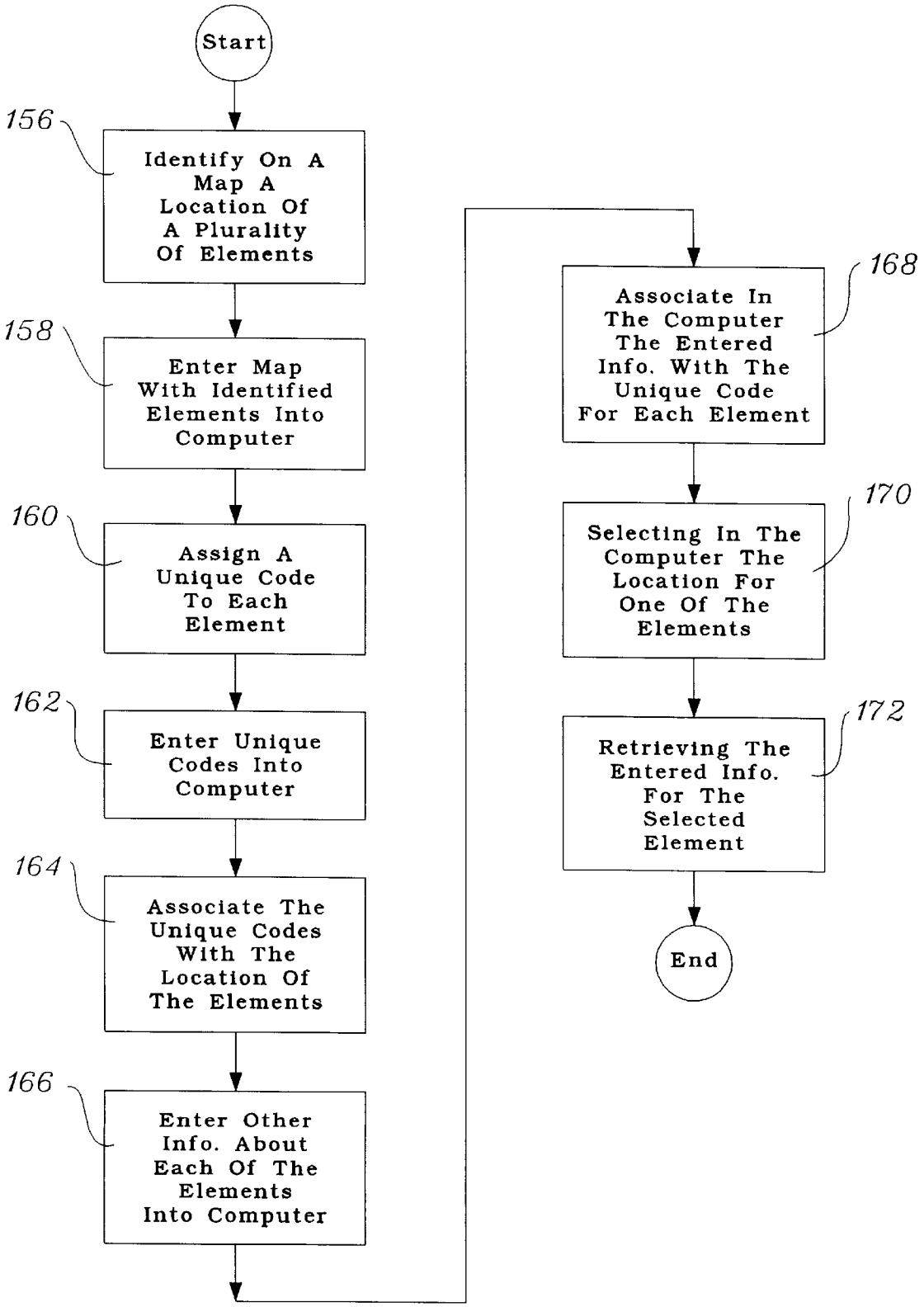

With reference to FIG. 5C, in still another embodiment, at step 156, the location of a plurality of elements is identified on a map. At step 158, the map with identified elements thereon is introduced into the computer and at step 160, a unique code is assigned to each element. At step 162, the unique codes are inputted into the computer and, at step 164, the unique codes are associated with the x-y location of their corresponding elements. At step 166, other information about each of the elements is entered, in the form of a record, into the computer and, at step 168, this information is associated with the unique code for each element. At step 170, an operator selects in the computer the x-y location for one of the elements. In response to this selection, at step 172, the record of the entered information for the selected element is retrieved from the computer.

Once displayed on visual display monitor 60, the one or more of the map data with sewer system including manholes, a record containing other information about a manhole in the sewer system, and a record containing a visual image of the sewer system, or combinations thereof, are printable on printer plotter 72 in response to operator entry of an appropriate print command via keyboard 62 or mouse 64.

From the foregoing, it can be seen that the present invention provides a method of organizing storing and retrieving information for the administration of a sewer system contained in a geographical region. Moreover, the present invention provides a method of organizing and tracking data for the administration of a utility.

The invention has been described with reference to the preferred embodiments. Obvious modifications and alterations will occur to others upon reading and understanding the preceding detailed description. It is intended that the invention be construed as including all such modifications and alterations insofar as they come within the scope of the appended claims or the equivalents thereof.

I claim:

1. A method of organizing, storing and retrieving information to administer a sewer system in a computer that includes a memory means and a display means, said method comprising the steps of:

assigning a street code to each of a plurality of streets in a geographical region that includes a sewer system having a plurality of manholes;

assigning a block code to each block of each of the plurality of streets in the geographical region;

assigning a manhole code to each manhole in each block of each of the plurality of streets;

combining the manhole codes with corresponding block codes and street codes to obtain a composite code for each manhole in the geographical region;

determining the location of each manhole in the geographical region;

displaying on a display means a map of the geographic region including the plurality of manholes plotted thereon;

determining on the displayed map of the geographical region an x-y location of each manhole plotted thereon corresponding to the determined location of each manhole in the geographical region;

associating in the computer each composite code with the x-y location of its corresponding plotted manhole on the displayed map;

obtaining information for at least one manhole in the geographic region;

introducing the information obtained for each manhole into a record in the computer corresponding to each manhole;

associating in the computer the record containing the obtained information for each manhole with the composite code associated therewith;

moving to one of said manholes plotted on the displayed map a computer generated icon;

selecting on said displayed map the one of said manholes to which the computer generated icon is moved;

retrieving the record containing the obtained information for the selected one of said manholes to which the computer generated icon is moved utilizing the composite code associated with the selected manhole; and displaying the retrieved record on the display means.

2. The method as set forth in claim 1 further including the steps of:

plotting on a map each composite code adjacent its corresponding manhole; and introducing the digitized map with composite codes thereon into the computer.

3. The method as set forth in claim 1 further including the step of assigning to each manhole at an intersection of two or more streets an intersection code comprised of the unique street code for each street, wherein the composite code is further comprised of the intersection code.

4. The method as set forth in claim 1 wherein the manhole code for each manhole not adjacent a street includes an off street designator, wherein the composite code is further comprised of the off street designator.

5. The method as set forth in claim 1 wherein the displayed map includes the composite codes viewable adjacent the plotted manholes.

6. The method as set forth in claim 1 further including the steps of:

obtaining a picture of the sewer system;

associating the picture with a selected manhole in the sewer system;

introducing the obtained picture into a record in the computer; and associating in the computer the record containing the picture with the composite code for the selected manhole.

7. The method as set forth in claim 6 further including the steps of:

retrieving the record containing the picture utilizing the composite code associated with the selected manhole; and displaying the retrieved picture on the display means.

8. A method of administering a sewer system contained in a geographical region utilizing a computer that includes a memory and a display device, said method comprising the steps of:

assigning a street code to each street in the geographical region;

assigning a block code to each block of each street in a listing;

assigning a manhole code to each manhole in each block;

merging the street codes, the block codes and the manhole codes to obtain a plurality of composite codes, wherein each composite code corresponds to a manhole in the geographical region;

determining on a viewable image of the geographical region displayed on a display device an x-y location of each manhole in the geographical region;

obtaining information about each manhole;

introducing the obtained information about each manhole into a record for each manhole in the computer;

associating the composite code for each manhole with its determined x-y location on the viewable image and the corresponding record containing the information obtained thereabout;

selecting on the viewable image utilizing a computer generated icon a determined x-y location of one of said manholes; and retrieving utilizing the composite code for said selected one of said manholes, the record containing the information obtained about said selected one of said manholes.

9. The method of administering a sewer system as set forth in claim 8 wherein composite codes of manholes at the intersection of two or more streets are comprised of the street codes of the intersecting streets.

10. The method of administering a sewer system as set forth in claim 9 wherein only one composite code is created for manholes at the intersection of two or more streets.

11. The method of administering a sewer system as set forth in claim 8 wherein composite codes for manholes positioned away from a street include an off street designator.

12. The method of administering a sewer system as set forth in claim 8 wherein the record containing the information about a manhole includes one or more of: diameter of the manhole; date of last camera inspection of the manhole; date of last cleaning of the manhole; the depth of the manhole; distance to upstream manhole; distance to downstream manhole; composite code of upstream manhole; composite code of downstream manhole; picture data of said manhole; and picture data of sewer lines connected to said manhole.

13. An apparatus for administering a sewer system contained in a geographical region, said apparatus comprising:

a computer having a computer memory which stores a digitized geographical map data of a geographical region that includes a plurality of manholes plotted thereon, said map data including the x-y location of each of the plurality of manholes plotted thereon, the computer memory storing a unique composite code for each of the plurality of manholes in the geographical region and storing records containing information regarding each of the plurality of manholes;

means for associating the map data x-y locations for each of the plurality of manholes with their corresponding composite codes;

means for associating the records containing the information regarding each of the plurality of manholes with their corresponding composite codes;

a viewing means which displays a viewable image of the map data with said manholes plotted thereon;

a computer generated icon for identifying one of said manholes plotted on said viewable image;

means for selecting the one of said manholes identified by the computer icon; and means for retrieving the record containing information regarding the selected one of said manholes utilizing the composite code associated therewith.

14. The apparatus as set forth in claim 13 further comprising:

a video camera which obtains video images of the sewer system;

a video recorder which records the video images of the sewer system obtained by the video camera on a storage means;

a video playback means which recovers from the storage means the video images recorded thereon;

means for storing a frame of the video images in a record in the computer's memory;

means for associating the record of the stored frame of the video image with a composite code for a desired manhole; and means for retrieving the record of the stored frame of the video image utilizing the composite code associated with the selected manhole.

15. The apparatus as set forth in claim 14 further comprising:

an operator input means; and a CPU which accepts operator input at the operator input means and which causes each composite code to be associated with one or more of the x-y location of each manhole on the digitized geographical map, the record containing the stored information for each manhole and the stored frame associated with each manhole.

16. A method of organizing and tracking data for the administration of a utility, said method comprising the steps of:

displaying on a computer generated display a map of a region containing a utility;

identifying on the displayed map of the region an x-y location for each of a plurality of elements associated with said utility;

assigning a unique code to each of the plurality of elements;

entering into the computer the unique code assigned to each of the plurality of elements;

associating in the computer the identified x-y location for each of the plurality of elements with the unique codes assigned thereto;

entering into the computer information regarding each of the plurality of elements into corresponding records in the computer;

associating in the computer the unique code assigned to each of the plurality of elements with their corresponding record;

identifying on the computer generated display of the map utilizing a computer generated icon an x-y location of one of said plurality of elements;

selecting the x-y location of the identified one of said plurality of elements; and in response to said selection, retrieving the corresponding record of the selected one of said plurality of elements utilizing the unique code assigned thereto.

17. The method of organizing and tracking data for the administration of a utility as set forth in claim 16 further including the step of displaying on a viewing means one or more of the selected locations, the unique code associated with the element at the selected location and the entered information.

18. The method of organizing and tracking data for the administration of a utility as set forth in claim 16 further including the step of storing on a computer readable medium one or more of said displayed map, the identified location of the plurality of elements, the unique codes and the record of information regarding the one of said plurality of elements.

19. The method of organizing and tracking data for the administration of a utility as set forth in claim 16 wherein the step of assigning a unique code to each of the plurality of elements includes sequencing the unique codes so that each element is assigned a code corresponding to its position relative to a fixed object in the region represented by the map.

* * * * *